US005239785A

United States Patent [19]

Allen

[11] Patent Number: 5,239,785

[45] Date of Patent: Aug. 31, 1993

[54] METHOD AND TOOL FOR FINISHING OF SHARPENED SKATE BLADES

[76] Inventor: Robert H. Allen, 155 Bechard Avenue, LaSalle, Ontario, Canada, N9J 1W4

[21] Appl. No.: 899,189

[22] Filed: Jun. 16, 1992

[51] Int. Cl.[5] ..... B23F 21/03

[52] U.S. Cl. ..... 51/285; 51/205 WG; 51/392; 76/81; 76/83; 15/210.1; 15/104.94

[58] Field of Search ..... 51/285, 205 WG, 214, 51/181 R, 181 NT, 391-393; 15/104.94, 210.1, 209.1, 235; 76/83, 81, 82, 88

[56] References Cited

U.S. PATENT DOCUMENTS

| | | | |
|---|---|---|---|
| 1,301,801 | 4/1919 | Adams | 76/81 |
| 1,521,714 | 1/1925 | Quintal | 76/81 |
| 1,672,508 | 6/1928 | Vallery | 51/205 WG |
| 1,722,400 | 7/1929 | Stevens | 51/393 |
| 2,075,348 | 3/1937 | Lara | 51/211 |
| 2,398,566 | 4/1946 | Talbert | 51/205 R |
| 2,550,765 | 5/1951 | Brown | 76/83 |
| 2,654,194 | 10/1953 | Raab | 76/81 |
| 2,764,854 | 10/1956 | Menken | 76/81 |
| 3,157,973 | 11/1964 | Chattillion | 51/205 WG |
| 4,189,847 | 2/1980 | Labriola | 51/181 R |
| 4,219,975 | 9/1980 | Scholler | 51/205 WG |
| 4,815,240 | 3/1989 | Larson | 51/205 WG |

FOREIGN PATENT DOCUMENTS

| | | | |
|---|---|---|---|
| 0158902 | 2/1933 | Switzerland | 76/83 |
| 0739532 | 11/1955 | United Kingdom | 76/81 |

*Primary Examiner*—Robert A. Rose

*Attorney, Agent, or Firm*—Lowe, Price, LeBlanc & Becker

[57] ABSTRACT

A skate blade finishing tool includes a holder adapted to be hand-held by a user. The holder includes at least one slot therein. Arranged in the slot is a strip of leather. In use, the leather strip in the slot is rubbed along the length of a sharpened skate blade in a predetermined number of passes. The leather strip removes foreign material redeposited by skate sharpening processes and small burrs remaining on the blade surface and smooths the skate blade surfaces. When using the skate blade finishing tool to finish a skate blade, the detrimental effects of the sharpening process are removed to provide a safe skating blade that also permits improved skating performance when using the finished blade.

20 Claims, 6 Drawing Sheets

BLADE FACE X 300

BLADE FACE X 300

BLADE EDGE X700

BLADE EDGE X700

BLADE EDGE X 3500

BLADE EDGE X3500

METHOD AND TOOL FOR FINISHING OF SHARPENED SKATE BLADES

FIELD OF THE INVENTION

The invention is directed to a method and tool for finishing of sharpened skate blades, and in particular, rubbing sharpened skate blade surfaces against a strip of leather to provide a uniform surface finish thereon to improve safety and skate blade performance.

BACKGROUND OF THE INVENTION

In the prior art, various methods and devices have been proposed for sharpening skate blades. Typically, skates are ground using a rotating abrasive wheel or the like. In these types of skate sharpening methods, the rotating wheels are generally revolving at high speeds to ensure adequate stock removal from the skate surface so as to provide a sharpened edge.

In addition to sharpening skates using a rotating wheel, portable or hand-held skate sharpening devices have been proposed for various purposes. In U.S. Pat. No. 2,398,566 to Talbert, a skate sharpener is disclosed which may be hand operated and carried in a pocket to facilitate sharpening of skates at any time or place. In this patent, the skate sharpener includes either a block of carborundum or a file as the sharpening element. U.S. Pat. No. 4,219,975 to Scholler discloses another hand-held skate sharpener which is designed to accommodate different widths of skates. Again, the skate sharpener of Scholler uses a cylindrical grindstone or an abrasive sheet as the sharpening member.

However, the prior art also recognizes that skate sharpening using a rotating emery wheel produces a sharpened skate blade which still has a roughened surface. In U.S. Pat. No. 1,672,508 to Vallery, a skate dressing tool is disclosed which is designed to smooth the roughness of a skate blade. In this tool, an abrading means such as sandpaper or emery cloth is provided in a hand-held tool for contacting a skate blade.

The prior art methods are still disadvantageous in that any abrading of the skate blade surfaces results in formation of burrs or impregnation into the skate blade surface of previously removed metal particles. As such, a need has developed for improved methods and devices for treating sharpened skate blades to enhance skate blade performance during use. The deficiency in prior art sharpening methods and devices is even more apparent in view of the increase demand of superior skate performance as a result of the demands made by increasingly athletic skaters.

In response to this need, the present invention provides a skate finishing tool and method which are designed to finish sharpened skate blades to achieve unexpected surface quality resulting in unexpected improvements in skate blade performance. In one aspect of the present invention, a skate finishing tool includes a tool adapted to be hand-held and having one or more strips of leather for treating a skate blade.

In the prior art, the use of leather in stropping devices for razor blades is known. Each of U.S. Pat. Nos. 2,764,854 to Menken, 2,075,348 to Lara, 1,521,714 to Quintal and 1,301,801 to Adams disclose a leather stropping device for use with razor blades. Each of these stropping devices is designed such that the side surface of the razor blade is generally held parallel to the stropping surface. None of these patents teach or fairly suggest using a leather for finishing a previously sharpened skate blade or using the leather such that the surface thereof is generally perpendicular to an edge to be treated or finished.

SUMMARY OF THE INVENTION

It is accordingly a first object of the present invention to provide an improved method for finishing sharpened skate blades and a skate finishing tool.

It is another object of the present invention to provide a method and tool for finishing sharpened skate blades that provides an improved surface which reduces friction during skating so as to improve skating performance.

Another object of the present invention is to improve safety during handling of skates by providing a skate surface that will not injure a user by inadvertent contact while providing a surface and edge facilitating improved skating performance.

A further object of the present invention is to provide a method and edge finishing tool which is adapted to treat various edges subjected to sharpening processes such as a ski edge of the like.

Other objects and advantages of the present invention will become apparent as a description thereof proceeds.

In satisfaction of the foregoing objects and advantages, the present invention comprises, in its broadest sense, a skate blade finishing tool for sharpened skate blades that includes a holder having at least one slot therein and a strip of leather arranged in the slot. The holder is adapted to be hand held by a user for finishing an already sharpened skate blade.

In another embodiment, the holder may include a pair of opposing slots with each slot containing a strip of leather therein. An additional strip of leather may be provided on a face of the holder for finishing the skate blade side surfaces.

The method of finishing a sharpened skate blade includes providing a skate blade having a sharpened edge and finishing the skate blade by rubbing at least a bottom edge of the skate blade along a strip of leather in a predetermined number of passes. The strip of leather, with its resilience and forgiving qualities, imparts a uniform and smooth surface to the blade as a result of contact therebetween. In another mode of the method of finishing, a polishing substance such as a metal or chrome polish may be applied to the strip of leather prior to rubbing the leather along the skate blade length. In finishing the blade edge, the skate blade contacts the strip of leather in a generally perpendicular fashion. In finishing the skate blade side surfaces, the strip of leather contacts the blade side surface in a generally parallel fashion.

In another embodiment of the invention, a finishing tool and method is disclosed for finishing snow ski metal edges. The snow ski finishing tool is especially adapted to finish a metal ski edge after sharpening to provide a uniformed, smooth and safe surface while maintaining the edge sharpness for skiing purposes.

BRIEF DESCRIPTION OF DRAWINGS

Reference is now made to the drawings accompanying the present invention.

DESCRIPTION OF THE PREFERRED EMBODIMENTS

Figure 1:
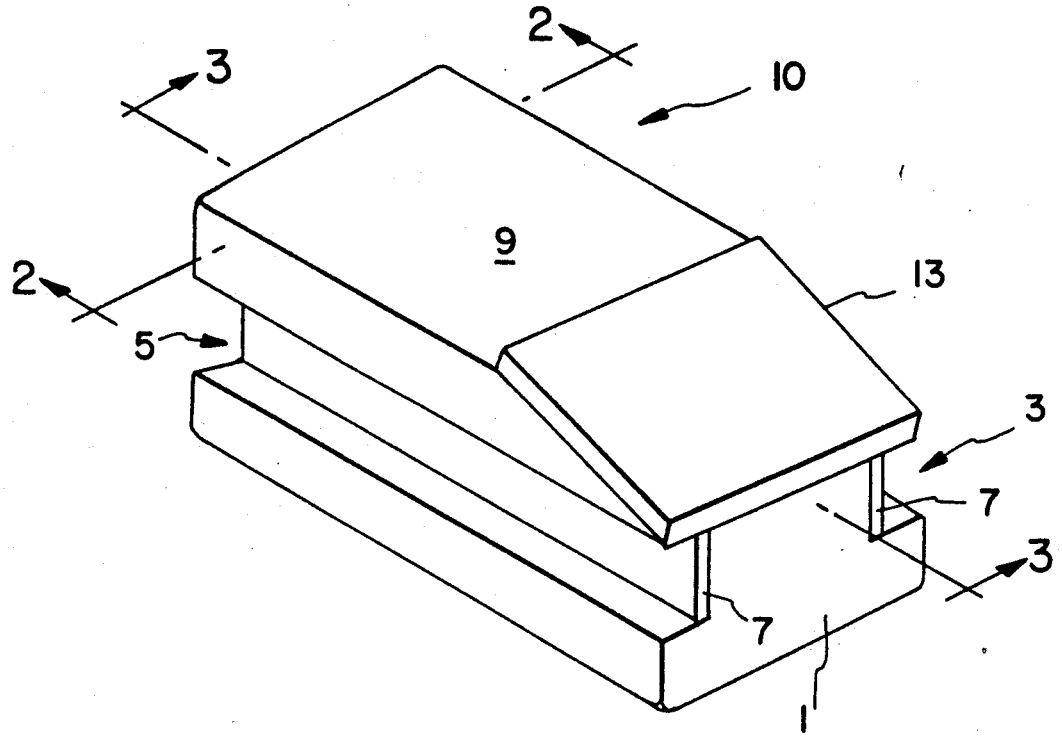
FIG. 1 is a perspective view of an exemplary skate finishing tool.

The method and tool of finishing a sharpened skate blade provides unexpected improvements in skate blade surface quality and skate blade performance during use. By subjecting a sharpened skate blade to a number of passes against a strip of leather, improvements in skate blade performance and safety are realized.

Skate blades treated according to the inventive method using the inventive blade finishing tool provide an edge which is sharp enough to cut a sliver from one's fingernail when passed across the edge in a particular manner but safe enough to run one's hand or wrist along the blade edge without cutting the skin. This combination of sharpness and safety is believed to be a result of the uniformity of the skate blade surface after repeatedly rubbing the skate blade against leather material for a predetermined period of time.

Improvements in a skating blade surface when subjected to the inventive method are demonstrated by passing a cotton ball along the skate blade edge. Rubbing a cotton ball along a blade edge that has been sharpened but not finished leaves a trail of cotton fibers along the length of the skate blade. This phenomena is believed to be a result of by-products of the sharpening process, e.g., unevenness, burrs and other projections along the skate blade surface which catch and retain the cotton fibers. After finishing the sharpened skate blade according to the inventive method, rubbing the cotton ball along the blade edge does not result in tearing of the cotton ball or adherence of individual fibers to the blade along the length thereof. The absence of cotton fibers adhering to the finished skate blade demonstrates the uniform and smooth surface quality of the skate blade when subjected to the inventive finishing process.

Besides providing an unexpected improvement in skate blade surface quality, finishing a sharpened skate blade according to the inventive method provides improved skating performance. As a result of the more uniformed and truer edge of the skate blade, a skater using sharpened skate blades that are finished according to the inventive method realizes improved performance. During skating, it has been found that skaters find is easier to push off and do not have to break their form or posture to try and push harder. Further, the enhanced skate blade surfaces and edge eliminate the usual "break-in" period associated with conventionally sharpened skates. The improved surface quality and result in reduction in friction between the skate blade and ice also permits skaters to skate with more speed for the same amount of effort exerted with conventionally sharpened skates.

By eliminating the effects of known sharpening processes, the inventive method and tool provides a true edge that does not release unexpectedly on turns. Often, a skate blade edge having an uneven surface quality collects ice which results in lost edges and poor skating performance. Using the inventive method and tool, surface quality is improved such that irregularities or imperfections in the skate blade surface and edge are eliminated, thereby preventing collection or formation of ice pockets.

In comparing skate blade and edge life between sharpenings, it has been demonstrated that skate blades subjected to the inventive finishing method have lasted twice as long as blades merely sharpened using conventional methods. For example, skating blades that normally would last 6 hours between sharpenings last 12 hours. Blades normally lasting 8 hours between sharpenings have an extended life of 16 hours before the blade must be resharpened.

The improvement in skating blade surface quality and edge also permits performing various skating maneuvers with less difficulty. For example, skating a one-foot circle eight is typically done on one foot with only one push off. Using skate blades finished according to the inventive method, higher speeds are able to be attained during the circle eight such that a moderate push off is sufficient to complete the manuever. Using skates sharpened according to conventional practices, skaters cannot maintain sufficient speed even with a greater effort push off to complete a one-foot circle eight. The unexpected improvements in skate blade edge and surface qualities will be demonstrated hereinafter using macrographs of a skate blade subjected to conventional sharpening and subjected to the finishing method according to the present invention.

It is believed that during a conventional sharpening process wherein an abrasive tool or material is used to sharpen skate blades, metal burrs are created on the skate blade surface. Moreover, loose metal particles removed from the surface as a result of abrading action of the tool or material become impregnated into the skate blade surface. The combination of incomplete metal removal leaving burrs and impregnation of metal particles into the surface leaves a roughened uneven surface for skating.

In using conventionally sharpened skate blades for skating, the metal burrs and impregnated metal particles break off and create pockets and a further uneven surface along the skate blade. The presence of pockets or depressions in the skate blade surface permit formation of ice which increases friction during skating and slows down a skater, provides a site for further ice formation through seeding which further increases friction and causes a loss of the skate blade edge during skating.

By finishing the sharpened skate blade with leather according to the inventive method, burrs and impregnated metal particles are removed from the skate blade surface. In addition, the surface is made uniform such that no pockets or depressions are present to permit formation of ice crystals or pockets.

The resiliency and forgiveness of the leather facilitates the skate finishing tool to contact substantially the entire surface of the skate blade, including blade side faces, blade edge and the blade hollow. The leather, being a non-abrading material, does not generate additional particulate matter so as to avoid impregnation thereof into the skate blade surface.

Again, skate blades finished using the inventive blade finishing tool according to the inventive method use less friction during skating which results in less fatigue to a user. The finished skate blades provide better control, flow, turns and acceleration. The finished blade edges stay sharper for longer periods of time and provide a more consistent edge for better skating performance. Since the edge stays sharper longer, the number of sharpenings is reduced for a given skate blade. This reduction in sharpenings provides an economic benefit as well as extending the life span of a particular skate blade.

Figure 2:
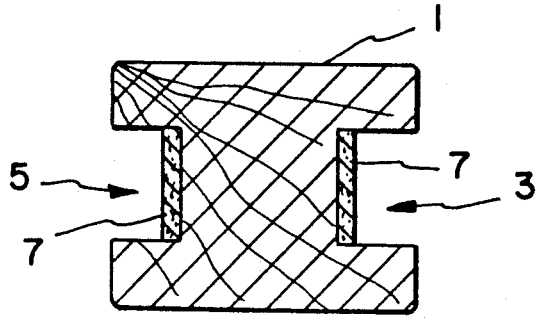
FIG. 2 is a cross-sectional view along the line 2—2 in FIG. 1.
Figure 3:
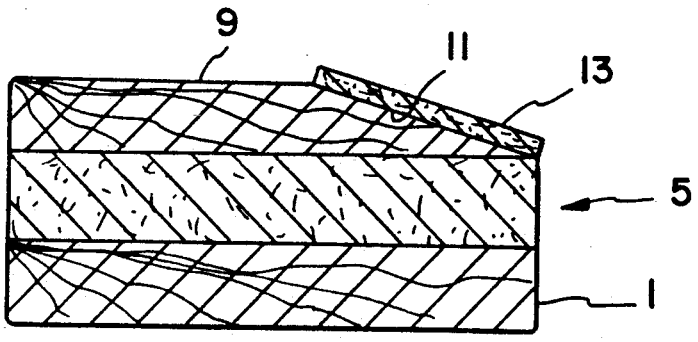
FIG. 3 is another cross-sectional view along the line 3—3 of FIG. 1.

With reference now to FIGS. 1-3, a first embodiment of the inventive finishing tool is generally designated by the reference numeral 10. The finishing tool 10 includes a body 1 which functions as a holder for a user during the finishing of a skate blade. The holder 1 has a pair of slots 3 and 5 disposed along opposing faces. Disposed within each slot is a strip of leather material 7. The leather may be secured in the slots in any known manner, including the use of adhesive, fasteners, clamps or similar holding or bonding means.

The holder 1 is configured in length, width and height so as to be handheld by a user for easy manipulation during finishing of a skate blade. Exemplary dimensions of the holder 1 include a 4½ inch length, 1½ inch width and 1½ height. Of course, other dimensions may be utilized for the holder as well as other configurations. Although the holder is shown as made of wood, other materials such as plastic may be used.

With particular reference to FIG. 3, top face 9 of the holder 1 includes an angled portion 11. Adjacent the angled portion 11 is a strip of leather material 13. As will be described hereinafter, the strip of leather 13 facilitates finishing the side faces of a skate blade when using the finishing tool in the prescribed method. The face 11 is angled at about 15° relative to the longitudinal axis of the slot 5 so that the leather strip 13 is generally vertically aligned when the holder 1 is held by a user. Of course, the leather strip 13 can be attached at different locations on the holder 1.

The method of finishing a sharpened skate blade will now be described. First, the skate blade is sharpened using a conventional abrading process. The skate blade should not be used until the finishing process is completed. After the skate blade has been sharpened the blade side surfaces may be lightly stoned with a skate stone having a relatively fine or smooth grinding surface. The skate stone should be placed flat against the side surfaces of the blade during the stoning step.

Figure 4:
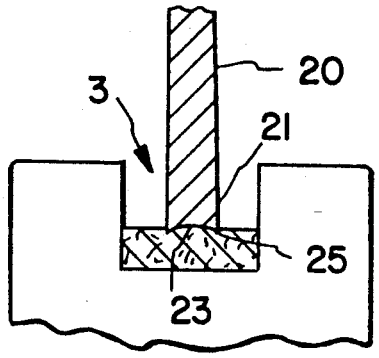
FIG. 4 shows a portion of the skate finishing tool depicted in FIG. 1 in an exemplary use of finishing a skate blade.

With reference now to FIG. 4, a skate blade having side surfaces 21, a blade hollow 23 and a pair of edges 25 is inserted into the groove 3. With steady pressure, the finishing block is rubbed up and down the length of the skate blade. The number of passes of the finishing block along the blade is dependent upon the degree of the skate sharpening. A sharpened skate having a relatively high degree of roughness would require more passes than a skate blade having a lesser degree of roughness. In a preferred mode, 10 to 15 passes of the skate blade along the leather strip 7 in the slot 3 is sufficient to finish the blade edge. As can be seen in FIG. 4, the resilience or forgiveness of the leather material 7 permits the leather to contact the entire surface area of the hollow 23 and edges 25.

After the blade edges and hollow are finished, the finishing tool is grasped such that the strip 13 passes along the blade side surfaces. As described above, the number of passes for the leather strip 13 against the blade side surfaces would be dependent upon the degree of sharpening performed on the skates.

In another mode of operation, a small amount of a polishing compound such as a metal polish, e.g. chrome polish, can be applied to the groove 3 prior to rubbing the finishing tool along the length of the skate blade. The use of this polishing substance further enhancing the surface quality of the blade surfaces.

To further enhance the skate blade quality, the finishing tool may be used to finish the blade edge and blade side surfaces after each skating session in the manner described above. It should be noted that in the simplest mode, the inventive method finishes at least the skating blade edges and hollow.

In an effort to further demonstrate the unexpected improvements in blade surface quality, macrographs of a skate blade were taken before and after the finishing method was employed thereon. In the macrographs depicted in FIGS. 5, 6 and 7, a single skate blade was sharpened using conventional techniques such as a grinding wheel. After the sharpening process, one half of the same skating blade was finished by rubbing the blade edge or blade side face along a strip of leather disposed in a holding device as described above.

Figure 5A:
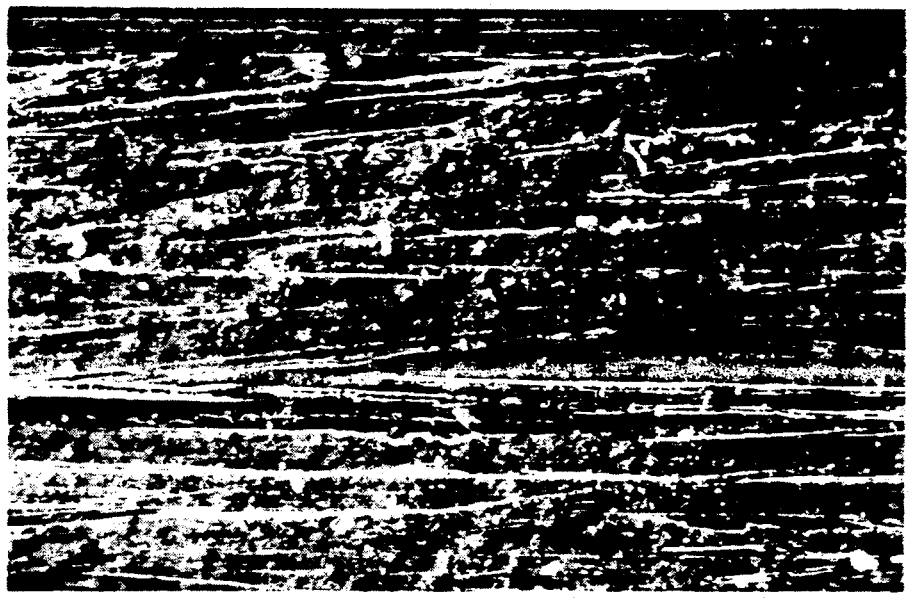
FIGS. 5A and 5B are macrographs of a blade face surface at 300× magnification after sharpening and after sharpening and finishing, respectively.
Figure 6A:
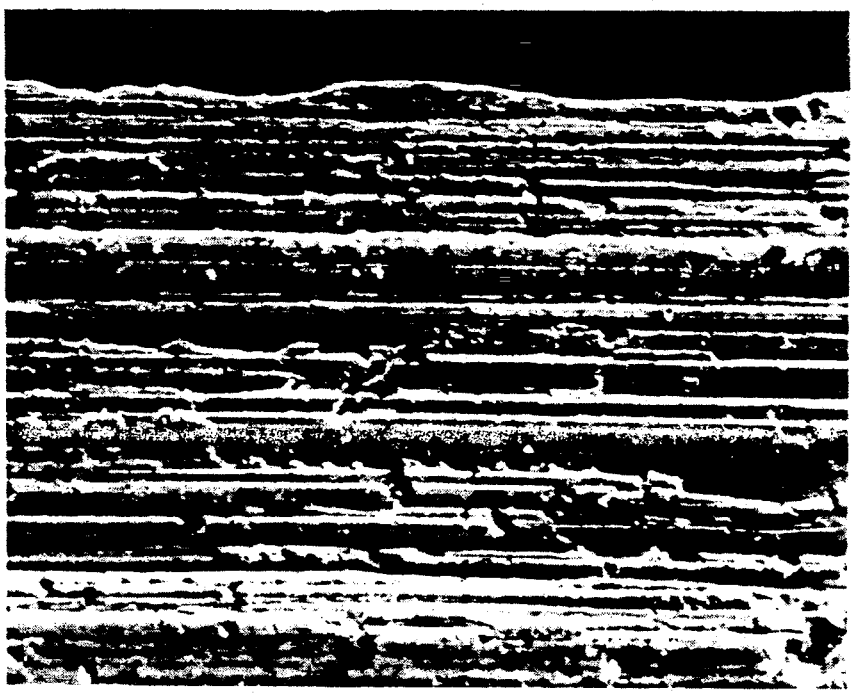
FIGS. 6A and 6B are macrographs of a blade edge at 700× magnification after sharpening and after sharpening and finishing, respectively.
Figure 7A:
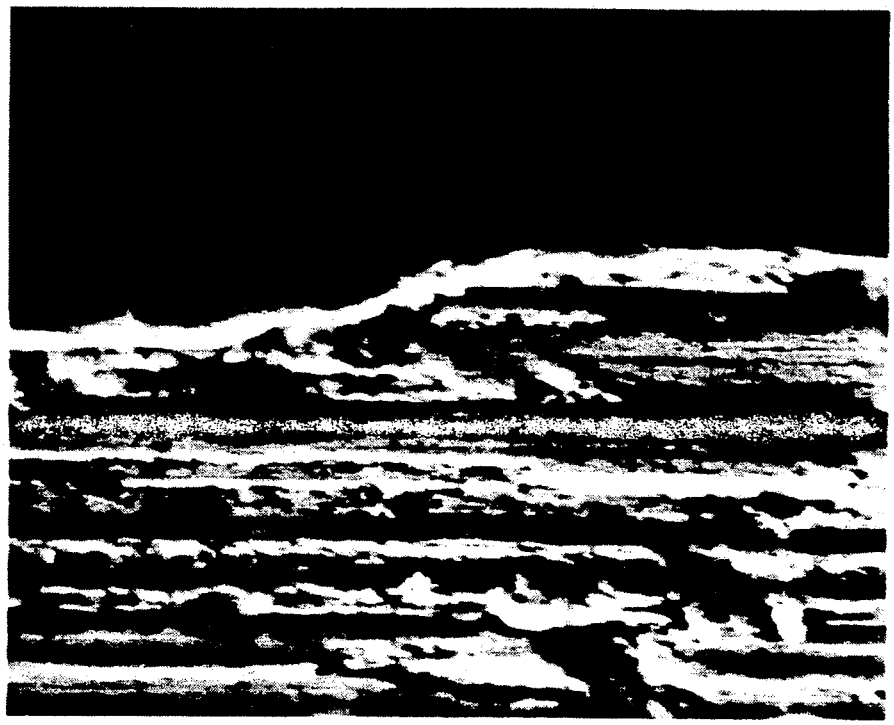
FIGS. 7A and 7B are macrographs of a blade edge magnified 3500× after sharpening and after sharpening and finishing, respectively.

FIGS. 5A, 6A and 7A illustrate the blade face or edge after the sharpening process has been completed but before finishing according to the invention. As is evident from these macrographs, the skate blade surface as sharpened is highly irregular in shape and contains numerous pits or pockets and portions of skate blade material extending outwardly from the surface thereof.

Figure 5B:
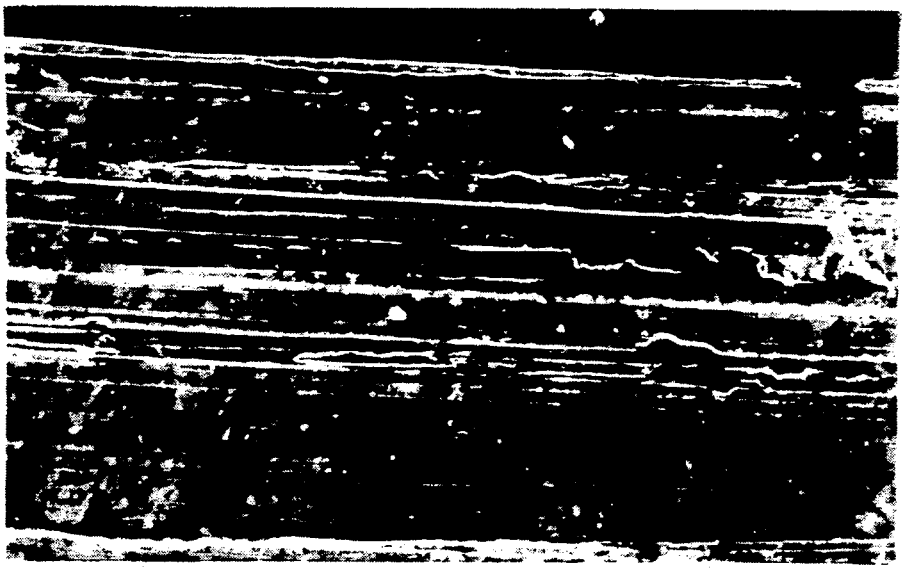
Figure 6B:
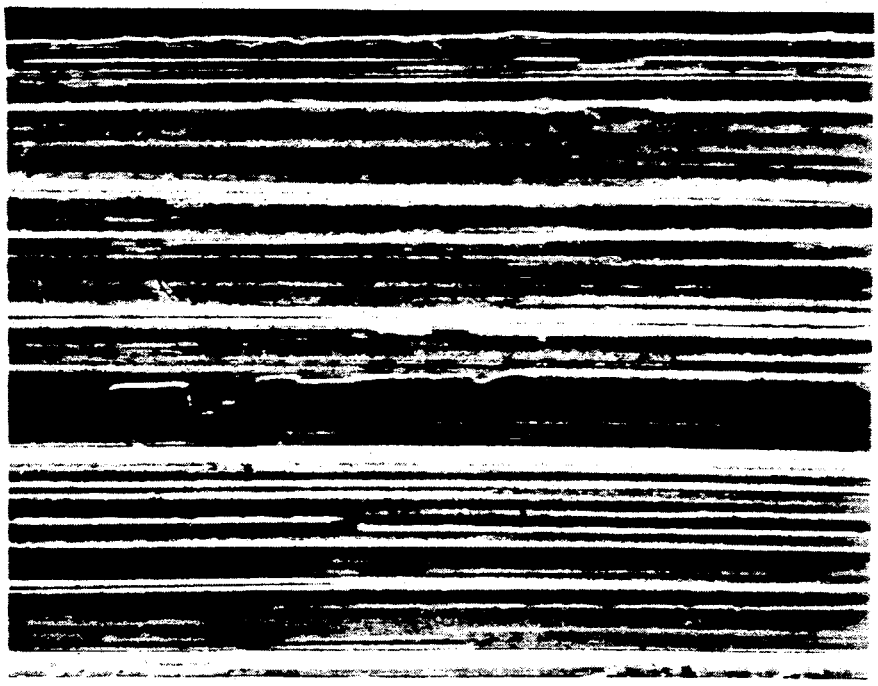
Figure 7B:
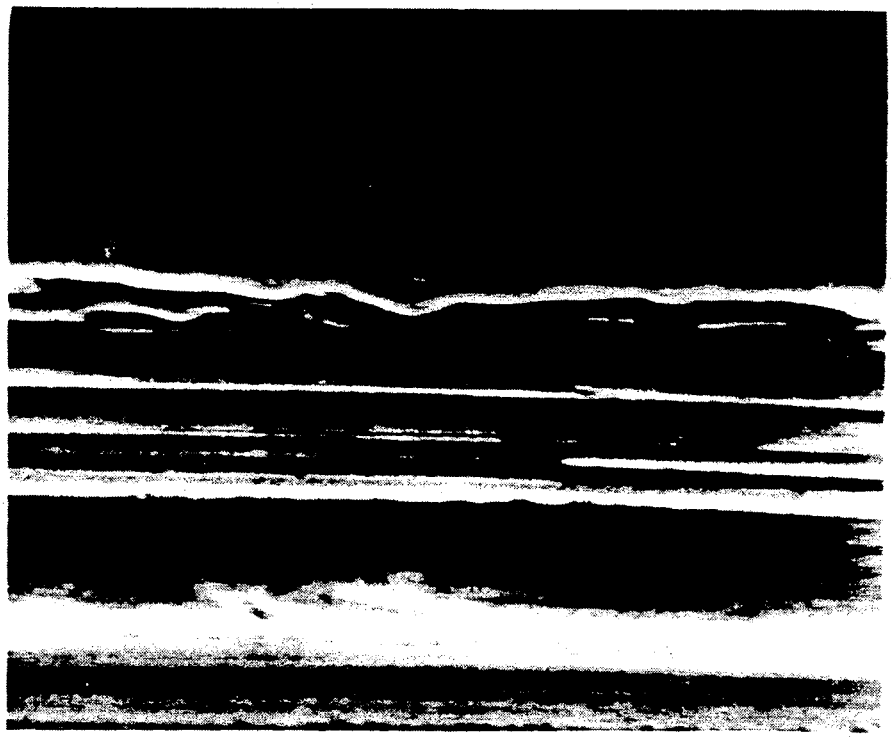

In direct contrast, FIGS. 5B, 6B and 7B clearly illustrate the finishing effect produced by contacting the skate blade surface with the strip of leather. The finished blade face and edge exhibits little or no pockets, depressions or extraneous metal extending outwardly from the surface.

In viewing the skate blade surfaces depicted in FIG. 5B, 6B and 7B, it is apparent that the burrs and extraneous material from the sharpened skate blade surface have been eliminated so as to provide the improved skating performance described above.

The leather strips used in the finishing tool 10 may be any type, such as cowhide, horsehide, calf skin or the like. The thickness of the leather strip may also vary. A preferred range of thickness would include between ⅛ to ⅜ inch. However, any thickness can be selected as long as the leather has sufficient thickness to contact substantially all of the blade surface being finished. For durability purposes, the leather should be at least ⅛ inch thick to provide a reasonable life span before having to replace the leather strip with another piece.

It should be noted that although the finishing tool is disclosed with a pair of opposing slots, the body 1 may include only a single slot. Preferred dimensions of the slots include about ⅜ inch thick and ½ inch in width. However, and depending on the particular skate blade to be finished, more narrow or wider slots can be used. In addition, the slot depth may vary depending on the thickness of the leather placed therein.

In yet another embodiment, the leather strip 7 may be disposed on both side faces of the slots 3 and 5 as well as on a bottom face thereof. In this embodiment, the blade side surfaces may contact leather at the same time as the bottom edge surfaces. The side faces leather strips also protect the blade side surfaces from inadvertent contact with the holder surfaces.

In a preferred embodiment, the holder 1 may be made out of wood or a plastic material. However, any material capable of being fabricated for hand manipulation as described above is suitable for the finishing tool. The holder material should be durable enough to withstand the pressure and manipulation during finishing of a skating blade.

Figure 8:
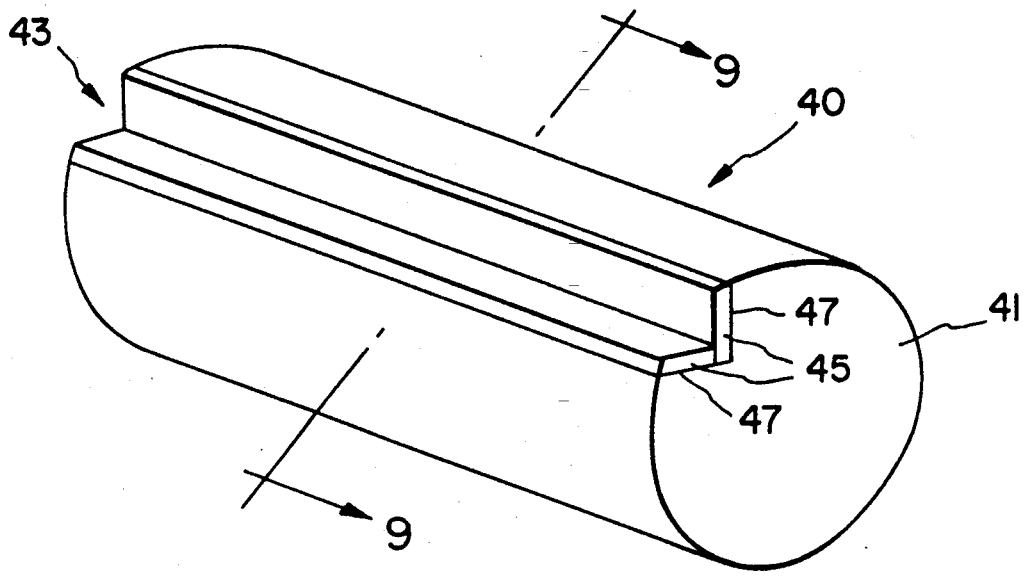
FIG. 8 is a perspective view of another embodiment of the present invention depicting a ski edge finishing tool.

In another embodiment of the invention, and with reference to FIG. 8, a ski edge finishing tool is generally designated by the reference numeral 40 and is seen to include a generally cylindrical holder 41 having a slot 43 therein.

Arranged in the slot are a pair of leather strip 45, each strip adjacent a slot face 47.

Generally, snow skis have a metal edge along the length thereof which is typically sharpened using an abrading stone or the like. It is believed that the same phenomena described above for skating blades occurs during sharpening of snow ski edges. Thus, the ski edge finisher 40 is particular adapted to finish the exposed metal surfaces and edge of a snow ski in the same manner as described above for skating blade.

Figure 9:
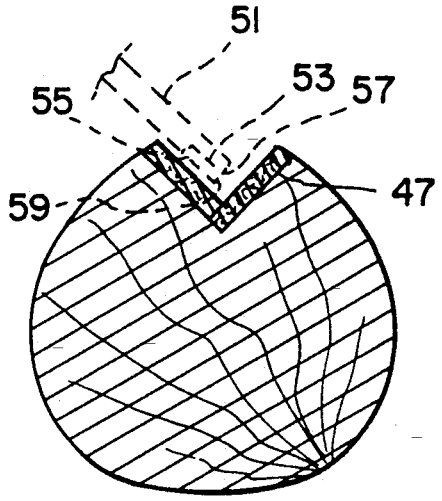
FIG. 9 is a cross-sectional view along the line 9—9 depicted in FIG. 8 and shows the ski edge finishing tool in an exemplary use.

With reference to FIG. 9, the cross-sectional view of the holder 40 is shown in an exemplary finishing of a snow ski 51. The snow ski 51 includes a metal edge 53 having exposed faces 55 and 57. By rubbing the ski edge finishing tool 40 along the metal edge 53 of the snow ski 51, the ski edge surface will be finished similar to the skate blade surface as described above. Moreover, the ski edge finishing tool 40 will maintain the sharpness of the apex 59 of the ski edge 53 for edging, carving turns and stopping purposes during skiing.

The slot 43 in the holder 41 is configured in a manner so as to avoid contact with ski brakes during the ski edge finishing process. Since ski brakes are generally positioned along the upper edge of a snow ski, the slot 43 and holder 41 must be configured so as to avoid contact therewith.

It should be understood that the method described above is generally applicable to finishing a snow ski edge. A snow ski edge may be sharpened manually using a sharpening stone or using a rotating grinding wheel as is commonly done for skating blades. In addition, the description above concerning various configurations of the holder and leather strips are applicable to the ski edge finishing tool.

As such, an invention has been disclosed in terms of preferred embodiments thereof which fulfill each and every one of the objects of the present invention as set forth hereinabove and provides a new and improved skate finishing tool and method of great novelty and utility.

Various changes, modifications and alterations from the teachings of the present invention may be contemplated by those skilled in the art without departing from the intended spirit and scope thereof. Accordingly, it is intended that the present invention only be limited by the terms of the appended claims.

I claim:

1. A method of finishing a sharpened skate blade comprising the steps of:

a) providing a skate blade having a sharpened edge; and b) finishing said skate blade by rubbing a bottom edge of said skate blade along a strip of leather for a predetermined number of passes while maintaining said skate blade generally perpendicular to a surface of said strip contacting said bottom edge;

c) whereby said rubbing step provides a uniform surface to said bottom edge to improve skating performance during use of said skate blade.

2. The method of claim 1 further comprising the step of rubbing each side face of said skate blade across another strip of leather to provide a uniform surface thereon.

3. The method of claim 1 further comprising the step of applying a polishing substance to said strip of leather prior to said finishing step.

4. The method of claim 2 further comprising the step of applying a polishing substance to each said strip of leather prior to said finishing step.

5. The method of claim 3 wherein said polishing substance is a metal polish.

6. The method of claim 2 wherein each of said side face is held generally parallel to said another strip of leather during said finishing step.

7. The method of claim 1 wherein said providing step further comprises providing a skate blade finishing device having a slot therein with said strip of leather in said slot.

8. The method of claim 2 wherein said providing step further comprises providing a skate blade finishing device having a slot therein with said strip of leather in said slot and a face thereon, said face including said another strip of leather.

9. A skate finishing tool for sharpened skate blades comprising:

a) a holder having at least one slot therein; and b) a strip of leather arranged on a base surface of said slot; said strip of leather being configured in said slot to contact a bottom portion of an edge of said skate blade when said skate blade is maintained generally perpendicular to said strip of leather for finishing said bottom portion to improve skate blade surface quality and skate blade performance during skating, wherein said holder includes a second strip of leather arranged on a face thereof, said second strip of leather being adapted to contact side faces of said skate blade for finishing surfaces thereof to improve skate blade performance during skating.

10. The skate blade finishing tool of claim 9 wherein said holder includes a pair of opposing slots and each said slot includes a strip of leather therein.

11. The skate blade finishing tool of claim 9 further including a polishing substance applied to said strip of leather.

12. The skate blade finishing tool of claim 9 wherein said holder is an elongated block having said slot in one face thereof and said face including said second strip of leather is disposed adjacent to said one face, said face being angled with respect to a longitudinal axis of said slot.

13. The skate blade finishing tool of claim 9 wherein said strip of leather has a predetermined thickness, said predetermined thickness providing sufficient resiliency such that said strip of leather contacts substantially the entire surface area of said bottom portion.

14. The skate blade finishing tool of claim 9 wherein said strip of leather is secured in said slot using an adhesive.

15. The skate blade finishing tool of claim 9 wherein said strip of leather is arranged on said slot on said base surface and each side surface thereof.

16. The skate blade finishing tool of claim 13 wherein said predetermined thickness is at least about ½ inch thick and said slot depth is at least about ⅜ inch.

17. The skate blade finishing tool of claim 12 wherein said adjacent face is angled at about 15° with respect to said longitudinal axis of said slot.

18. The skate blade finishing tool of claim 9 wherein said holder is sized to facilitate gripping said holder by a user's hand to such that said user can manipulate said holder to finish a said skate blade.

19. A skate finishing tool for sharpened skate blades comprising:

a) a holder having a pair of opposing slots therein; and b) a strip of leather arranged on a base surface of each said slot; each said strip of leather being configured in each said slot to contact a bottom portion of an edge of said skate blade when said skate blade is maintained generally perpendicular to said strip of leather for finishing said bottom portion to improve skate blade surface quality and skate blade performance during skating.

20. A skate finishing tool for sharpened skate blades comprising:

a) a holder having at least one slot therein; and b) a strip of leather arranged on a base surface of and each side surface of said slot; said strip of leather being configured in said slot to contact a bottom portion of an edge of said skate blade when said skate blade is maintained generally perpendicular to said strip of leather for finishing said bottom portion to improve skate blade surface quality and skate blade performance during skating.

* * * * *